US006151923A

United States Patent [19]

Gruenert et al.

[11] Patent Number: 6,151,923

[45] Date of Patent: Nov. 28, 2000

[54] APPARATUS FOR SUPPLYING A MULTI-LAYER, MULTI-AXIAL LAYER OF YARN TO THE KNITTING SITE OF A WARP KNITTING MACHINE

[75] Inventors: Jan Gruenert, Chemnitz; Frank Vettermann, Jahnsdorf; Dietmar Reuchsel; Dietmar Grenzendoerfer, both of Chemnitz; Dieter Erth, Gruena; Jens Fischer; Klaus Wiedenhoeft, both of Chemnitz, all of Germany

[73] Assignee: Karl Mayer Malimo Textilmaschinenfabrik GmbH, Chemnitz, Germany

[21] Appl. No.: 09/412,343

[22] Filed: Oct. 5, 1999

[30] Foreign Application Priority Data

Nov. 13, 1998 [DE] Germany ..... 198 52 281

[51] Int. Cl.[7] ..... D04B 23/22

[52] U.S. Cl. ..... 66/84 A

[58] Field of Search ..... 66/83, 84 R, 84 A, 66/125 R

[56] References Cited

U.S. PATENT DOCUMENTS

| | | | |
|---|---|---|---|
| 4,325,999 | 4/1982 | Campman et al. . | |
| 4,348,876 | 9/1982 | Roth | 66/84 A |
| 4,437,323 | 3/1984 | Hittel et al. | 66/84 A |
| 4,442,684 | 4/1984 | Bergmann et al. | 66/84 A |
| 4,706,475 | 11/1987 | Wunner | 66/84 A |
| 5,269,863 | 12/1993 | Middelman | 66/84 A |

FOREIGN PATENT DOCUMENTS

| | | |
|---|---|---|
| 3343048 | 6/1985 | Germany . |
| 3447643 | 8/1989 | Germany . |
| 4309990 | 10/1994 | Germany . |

*Primary Examiner*—Danny Worrell
*Attorney, Agent, or Firm*—Jordan and Hamburg LLP

[57] ABSTRACT

An apparatus for supplying a multi-layer, multiaxial yarn stratum to the knitting site of a warp knitting machine, with endless conveyor chains for guiding the yarn stratum to the knitting site, with at least two multiple yarn guides, which can be moved changeably over both conveyor chains for each yarn sheet and with means for supporting the yarn stratum. The prelaid yarn stratum is supplied in such a manner, that at least one endless conveyor belt is driven synchronously with the conveyor chains and supports the yarn stratum, and is guided over guide rollers mounted on the frame with the distance between the guide roller and the knitting site bridged with the help of supporting guiding elements for the yarn stratum.

20 Claims, 7 Drawing Sheets

APPARATUS FOR SUPPLYING A MULTI-LAYER, MULTI-AXIAL LAYER OF YARN TO THE KNITTING SITE OF A WARP KNITTING MACHINE

BACKGROUND OF THE INVENTION

This invention relates generally to warp knitting machines, and more particularly to a method and an apparatus for supplying a multi-layer, multi-axial yarn stratum to the knitting site of a warp knitting machine which is equipped with endless longitudinal conveyors running toward the knitting site with their upper strands on either side of the knitting site and having chains which are edged with hooks for guiding the yarn stratum so that at least two multiple yarn guides for each yarn sheet are located over both conveyor chains and are changeably movable, with at least one of the multiple yarn guides having a central movement path inclined at an acute angle to the direction of motion of the conveyor chains wherein the stratum is fed between the conveyor chains by means for supporting the yarn.

An apparatus of the type described above is taught in U.S. Pat. No. 4,325,999. Several layers of parallel yarn sheets are deposited between endless conveyor chains, which are disposed parallel to one another and the upper strands of which are moved in the cast-off plane of the knitting site toward the latter. The sum of all yarn layers or yarn sheets is referred to as a yarn stratum.

The endless conveyor chains are equipped with hooks, in which several multiple yarn guides or filling yarn guides, which can be moved in different directions to the conveyor chains, suspend yarn sheets consecutively and one over the other.

Depending on the number and the respective density of these yarn sheets and depending on the thickness of the yarns or fibers contained therein, a yarn with a considerable mass may result.

With the objective of preventing sagging of this heavy yarn stratum, the conveyor chains are provided with a stable lateral guide, particularly in the region of their upper strand.

However, with such a lateral guide, the yarn stratum cannot be positioned precisely horizontally before it reaches the knitting site of the warp knitting machine. The conveyor chains can absorb only limited forces laterally. Under the possible high load of yarns, the hooks can deform or break.

In order to lessen the effect of this problem, the manufacture of such knitted fabrics has, in the past, been limited to a certain width. The sag of the yarn sheets, which is nevertheless unavoidable, has been countered by providing the inlet region of the knock-over bits of the knitting site with large, arc-shaped inlet sections. Such arc-shaped inlet sections compensate for the sag in the yarn stratum and enable it to be brought straight over the whole of the working width to the cast-off plane, which is indispensable for the knitting process.

Such arch-shaped inlet sections can compensate for only slight sags, and, especially in the middle region, lead to a clear shifting of the lower layer of the yarn stratum. This shifting is fixed by the knitting process that follows immediately, and remains as a defect or irregularity in the goods.

Even if such irregularities can be tolerated in the finished knitted fabric, such fabrics can be produced in only relatively narrow widths.

If special runs of knitted fabric are to be produced by this method and not limited in width to the previously customary 50 inches, then such a method is not at all practicable. When production of wider fabrics is attempted, a reliably consistent sag of the yarn stratum cannot be ensured merely by the lateral guidance of the conveyor chains with a corresponding absorption of forces. The hooks at the conveyor chains would also no longer withstand the forces necessary for stretching the yarns.

Other disadvantages become apparent if, in accordance with U.S. Pat. No. 4,325,999, supporting elements in the form of a stretched sheet, guided over rollers, are disposed below the yarn strata. At the knitting site, this sheet is combined with the yarn stratum and remains a component of the fabric. This is highly unsatisfactory, if the sheet is not required as a component of the yarn stratum.

Without reference to the problem above, it is proposed in DE 33 048 A1 that so-called stationary yarns be supplied between each layer of yarns. Such stationary yarns, which can be stretched between their feed roller and the knitting site, can support the layer of yarns placed over them and minimize the sagging of this yarn stratum. In this case also, these additional, supporting yarns are tied into the knitted fabric. They lead to a larger, generally unnecessary thickness of the knitted fabric. In most cases, the structure build-up required excludes the use of this method. Higher costs and a higher weight are an inevitable consequence.

SUMMARY OF THE INVENTION

It is an object of the present invention to guide and transport the yarn sheets, already before the first such yarn sheet is laid, in such a manner, that sagging of the yarns is avoided from the very start, even if these yarns are very long and the specified position of the yarn stratum is retained up to the knitting site. The lateral stressing of the conveyor chain and their hooks is to be limited to a minimum.

In accordance with the present invention, commencing from the action of the first yarn laying device, the yarns are deposited on the level upper surface of the upper strand of a longitudinal conveyor belt supported from below. The strand moves at the same speed as the conveyor chains. Sagging of the yarns and mutual shifting of the yarn layers is precluded from the very start in this phase.

Of course, the upper strand of this conveyor belt cannot be guided into the region of the knitting site (needle plane), as can a sheet or an additional yarn sheet. At a distance from the knitting site, it is guided back downward away and then towards the rear.

The invention has stationary guiding elements which take over the support of the yarn stratum directly or indirectly in the region between the last set of the guide rollers providing stable guidance of the conveyor belt and the knitting site. Even when the working width is large, the yarn stratum is consolidated in the specified form by the knitting process.

Consequently, the invention permits a larger working width of production, thus opening up new areas of use for such wider knitted fabrics and providing for a wider range of applications for known areas of use.

Another benefit of the invention is that there is clearly less stress on the conveyor chains, transversely to the direction in which they are revolving. The guiding effort for the conveyor chains is decreased. The danger that the hooks of the conveyor chains will be deformed or break is greatly reduced.

The stretching of the yarn sheets, which are supplied for forming the yarn layers of each stratum, can also be reduced. As a result, the danger of yarn breakages is reduced. The interruptions for eliminating yarn breakages, frequently under very complicated conditions, are clearly reduced.

The invention also provides for the support of the yarn stratum and its undisturbed transport into the immediate vicinity of the knitting site. If the lowest yarn stratum is aligned diagonally, the transition from the conveyor belt to the knockover bits can be realized without problems.

If the stationary guiding elements support the yarn stratum directly, additional driving elements can be assigned to the yarn stratum in order to avoid yarn deflections due to the friction of the guiding elements at the lowest layers of the yarn stratum. Even if the working width is very large, the yarn strata can be transported in their originally defined position into the region of the knitting site in this way and be connected with one another there. A guiding system of this type enables the accessibility to the needle bar and the slider bar with minimal effort.

An accumulation of yarns at the lowest yarn layer can be avoided at the transition from the single conveyor belt to the guiding elements by providing the supporting conveyor belt with grooves disposed in the revolving direction.

The use of a large number of narrow individual conveyor belts which are guided parallel to one another, has a similar effect. The guiding elements or the knock-over bits can engage between these conveyor belts. The reliability of the back-up-free transition can thus be increased.

To ensure the advance of the yarn stratum between the conveyor belt and the knitting site during the movement over the guiding elements and/or knock over bits, one of the lower yarn layers, which preferably is aligned diagonally, can be used as a driving means. The relatively short, stretched individual yarns of this yarn stratum are connected with the conveyor chain, with the take-down conveyor chain, with the take-down device for the finished knitted fabric and with the supported conveyor belt. They retain the stretched position and can effectively prevent the shifting of other yarn layers of the yarn stratum.

The construction of the driving element is more significant if the lowest yarn layer must be directed almost parallel to the row of needles of the knitting site. In this case, the endless wires take over at least sectionally the guidance of the yarn stratum and also the propulsion of the yarn stratum between the discharging position from the conveyor belt and the knitting site. The endless wires can be guided either in the grooves of the conveyor belt or in the spaces between narrow conveyor belts. Between the conveyor belt and the knitting site, they slide preferably on plate-shaped guiding elements, which may be provided with guiding grooves for the wires.

In the region where the loops are formed, the endless wires can be guided in both directions—between the needles—preferably below the cast-off plane. This offers advantages for the installation and maintenance of these wires. If many individual, narrow conveyor belts are used, it is only necessary to guide these endless wires about the guide roller of the conveyor belt, located close to the knitting site, in the cast-off plane through the needle row and behind the needle row, over a further idle roller and through the spaces between the needles back into the spaces between the narrow conveyor belts.

A preferred embodiment of the invention enables the length of the endless wires to be reduced and the handling of the endless wires during the maintenance to be simplified. It is not necessary to take these wires around the driving mechanism of the knitting elements and around the drive shaft of the endless conveyor belts.

In another preferred embodiment of the invention, driving elements, working at the sewing machine, are assigned to the guiding elements above the yarn stratum in the form of a feed dog. Such driving elements can be driven synchronously with the loop formation of the knitting site.

BRIEF DESCRIPTION OF THE DRAWING FIGURES

The foregoing and other novel features and advantages of the invention will be better understood upon a reading of the following detailed description taken in conjunction with the accompanying drawings, in which similar reference characters denote similar elements throughout the several views.

FIG. 1 shows a diagrammatic vertical section through the region of a knitting site of a warp knitting machine.

FIG. 1*a* shows a partial section, enlarged along the line A—A of FIG. 1.

Figure 6:
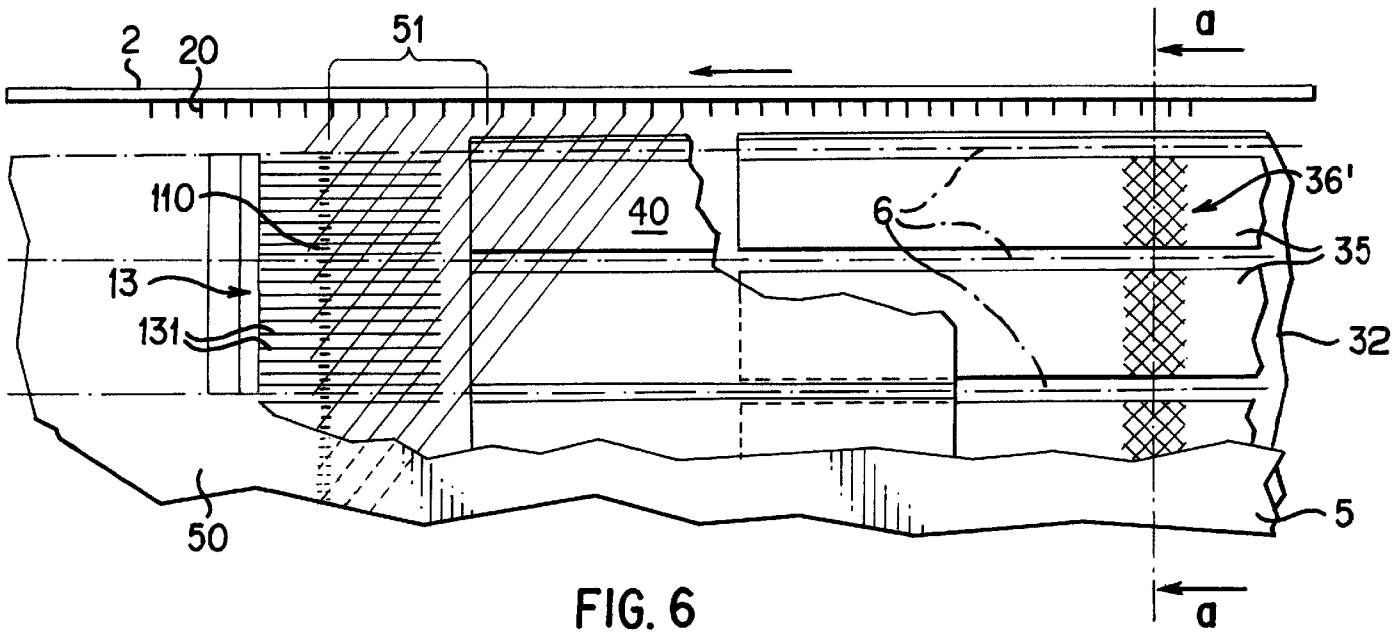
FIG. 6 shows a variation of the guiding system for the yarn stratum to the knitting site with endless wires in a sectional representation similar to that of FIG. 4.
Figure 6A:
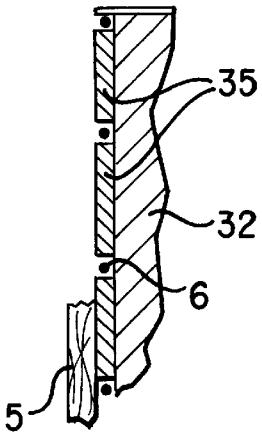

FIG. 6*a* shows a partial section along the line a—a in FIG. 6.

Figure 7:
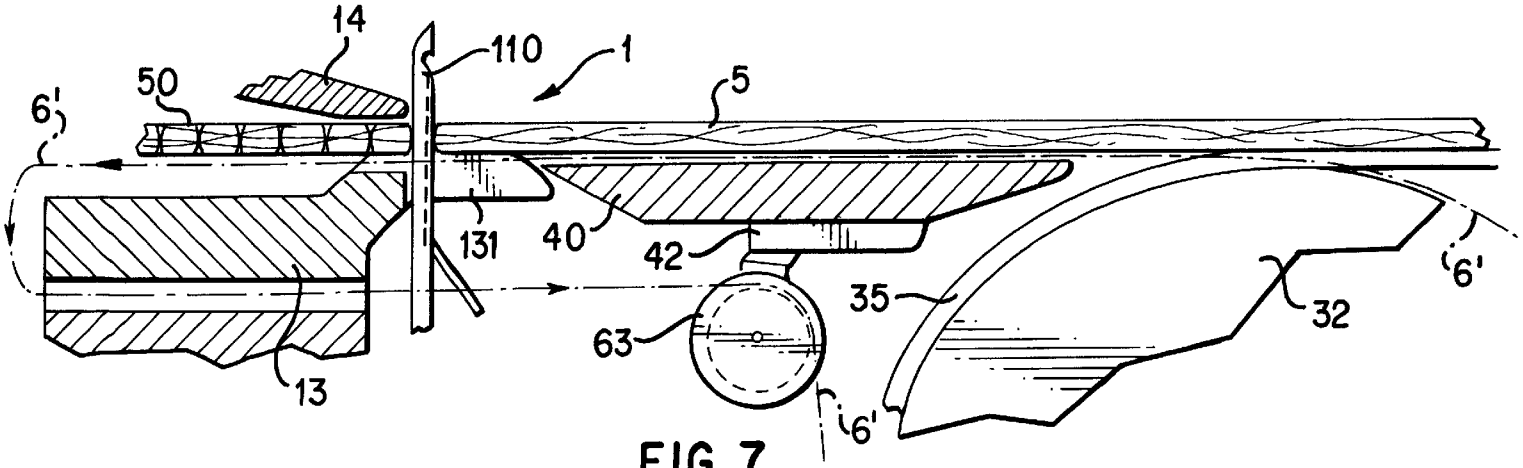

FIG. 7 shows a cross-sectional representation of FIG. 6.

Figure 8:
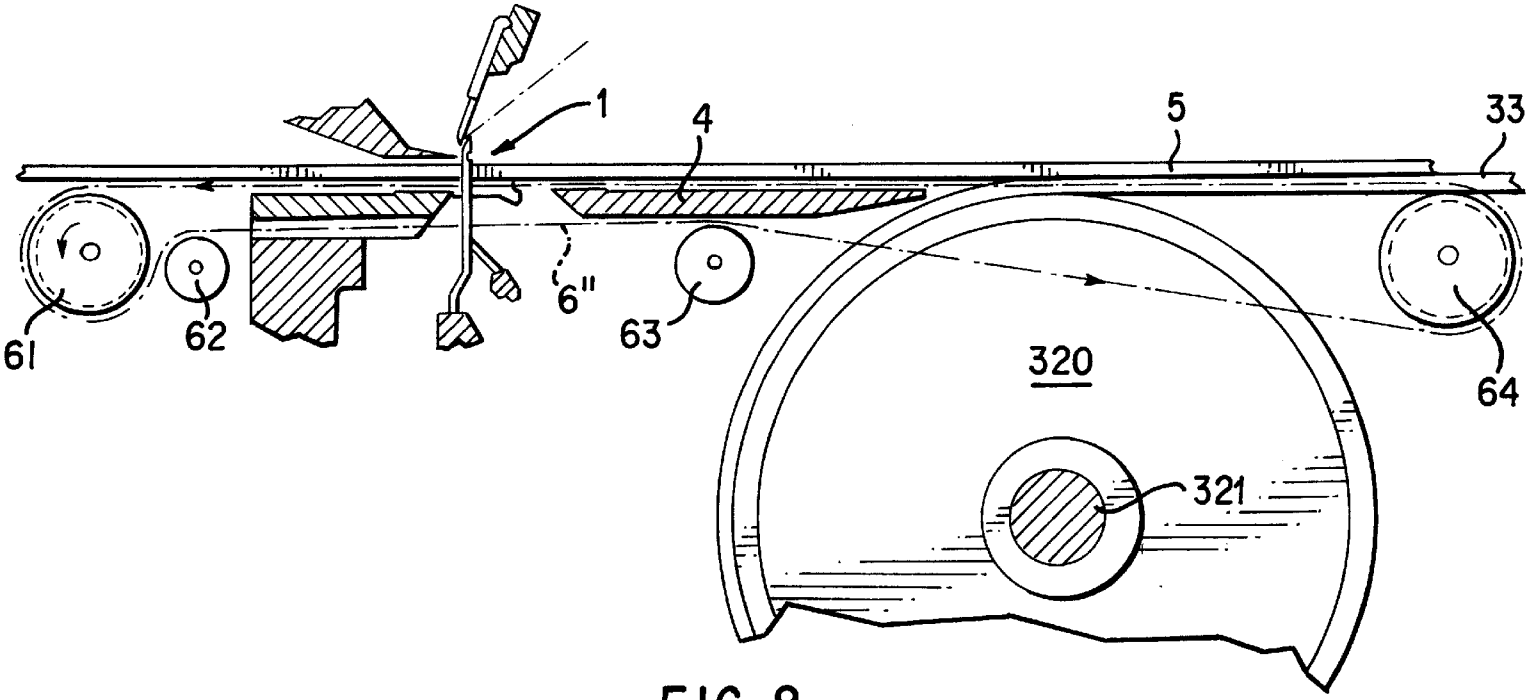

FIG. 8 shows a special type of guidance for endless wires as driving elements in a diagrammatic cross section.

Figure 9:
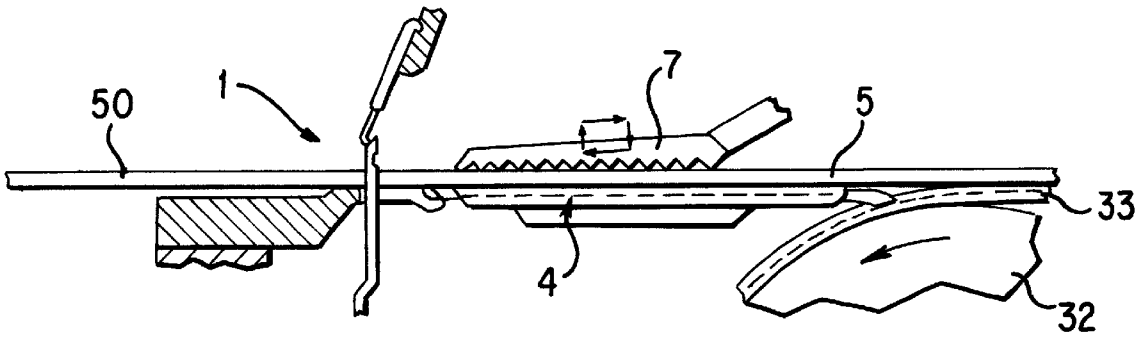

FIG. 9 shows a cross-sectional representation of the guiding and driving elements with a vibrating feed dog.

Figure 10:
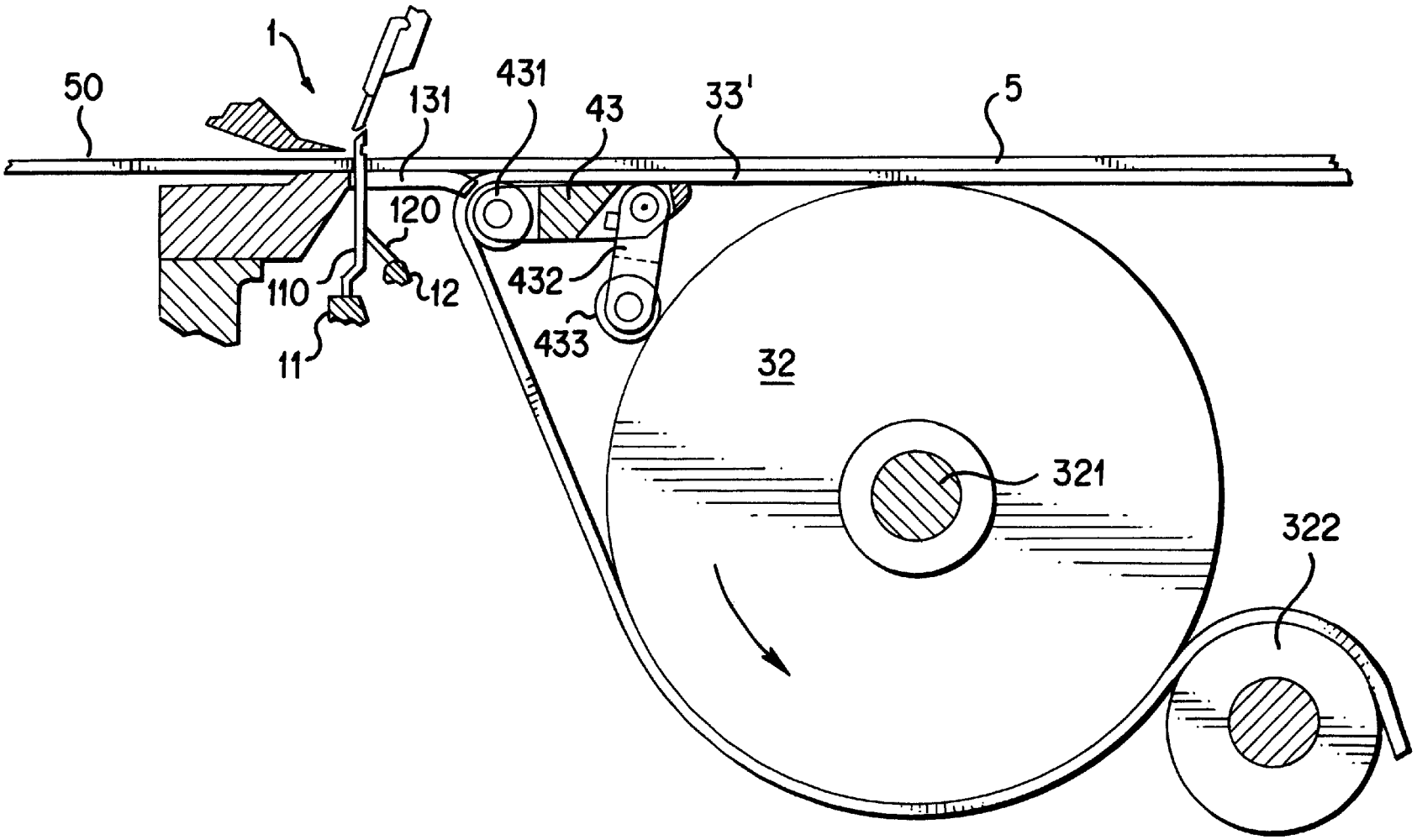

FIG. 10 shows a diagrammatic representation of the guiding and driving elements, for which the conveyor belt is guided around the guiding elements and turned around shortly before the knock-over bits and guided back to the guiding rollers.

DETAILED DESCRIPTION OF THE PREFERRED EMBODIMENTS

The above-described drawing figures illustrate the invention as an apparatus for supplying a multi-layer, multi-axial yarn stratum to the knitting site of a warp machine. In a preferred embodiment of the invention, the apparatus of FIGS. 1 and 1*a* comprises a knitting site 1 of the warp knitting machine which is equipped with a needle bar 11, having needles 110 which are aligned vertically and which are also movable in this plane. A slider bar 12 with sliders 120 moves parallel to the needle bar 11. A cast-off cam 13, with knock-over bits 131 held in holders, is fastened to the frame.

During the knitting process, the yarn stratum 5, sliding horizontally, is guided on a knock-over edge of the knock-over bits 131. The counter bar 14 and the holding-down bar 15, disposed above the yarn stratum 5, hold the latter during the insertion of the needles 110 into the yarn stratum 5 in this plane. Conventional knitting yarn guides 17 and also stationary yarn guides 16 complement the knitting site 1.

Figure 2:
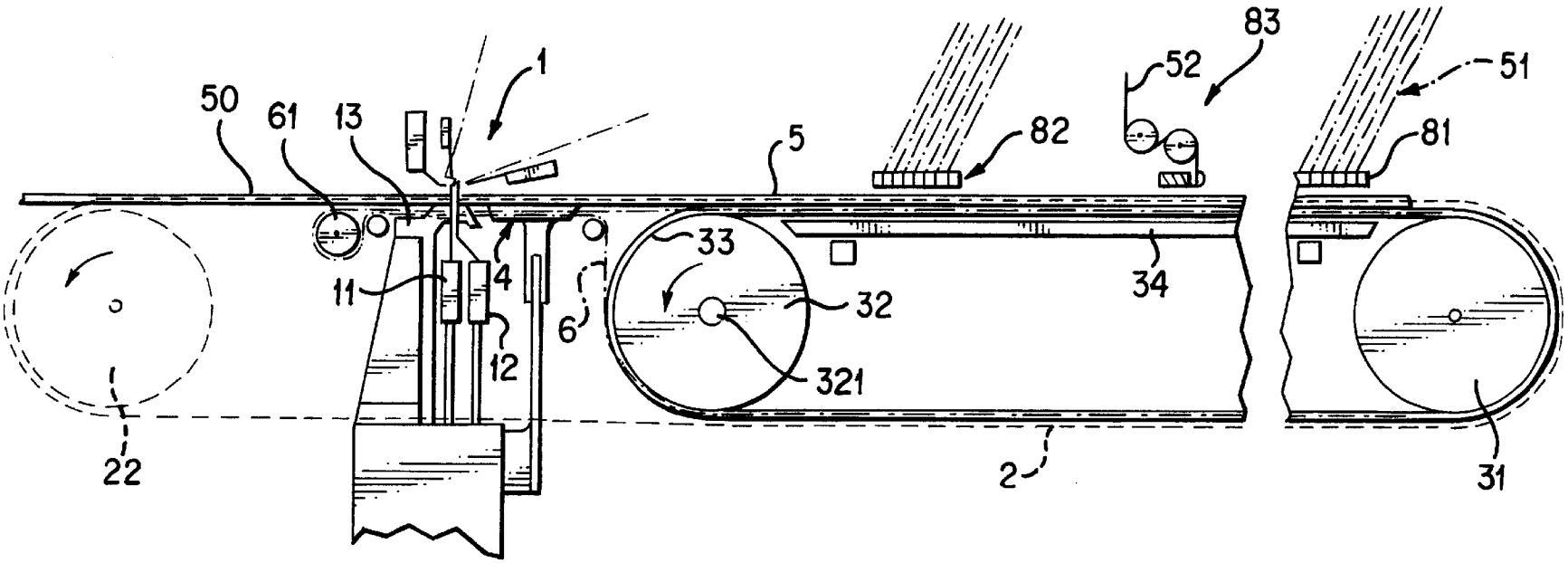
FIG. 2 shows a diagrammatic vertical cross section along the working direction through the equipment as a whole.
Figure 3:
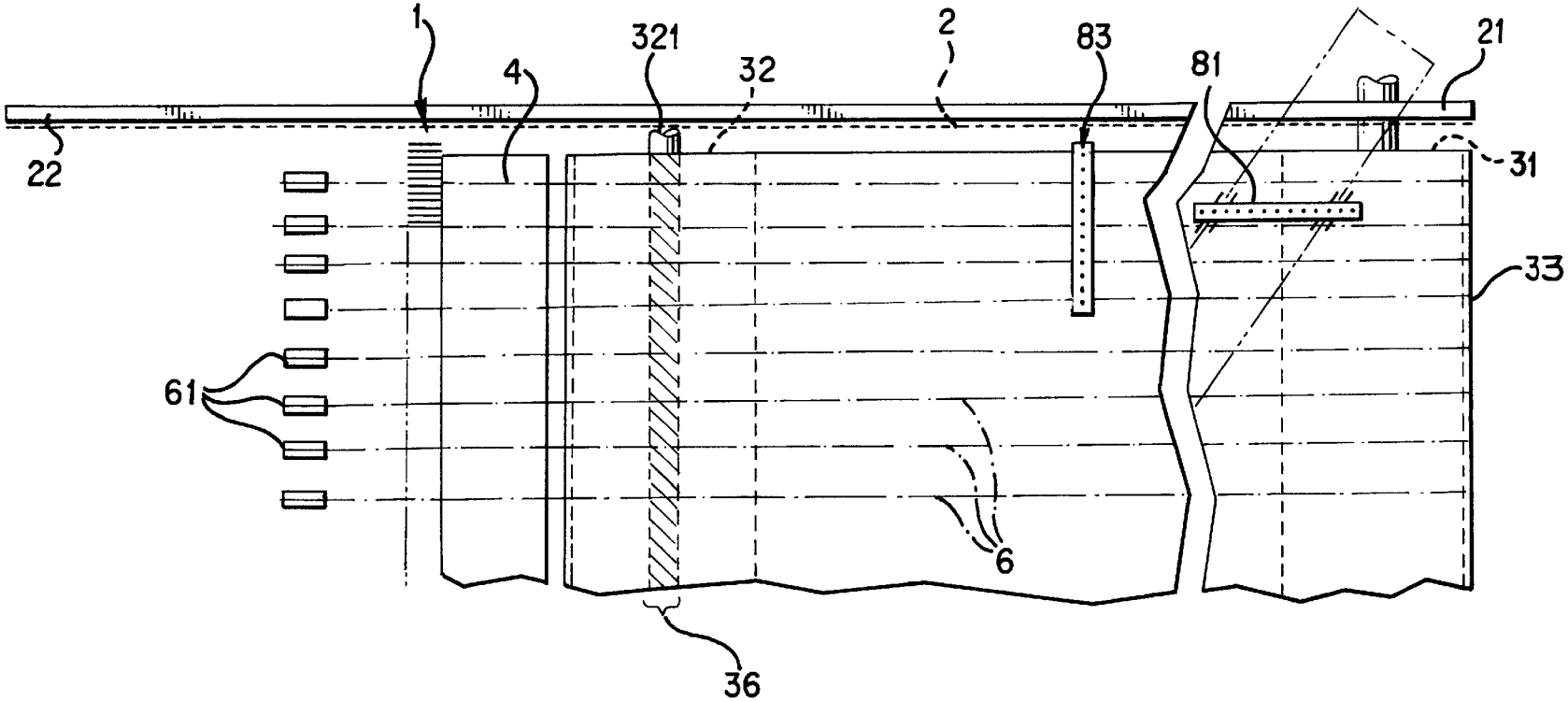
FIG. 3 shows a diagrammatic partial view of the equipment of FIG. 2 as a whole, in the region of a conveyor chain.

As illustrated in FIGS. 2 and 3, the yarn stratum 5 is passed by the conveyor chains 2 and the conveyor belt 33 into the region of the knitting site 1. There it is taken over initially by the guiding elements 4. The yarn stratum 5 now slides on these guiding elements 4 to the cast-off cam 13 of the knitting site 1.

Figure 4:
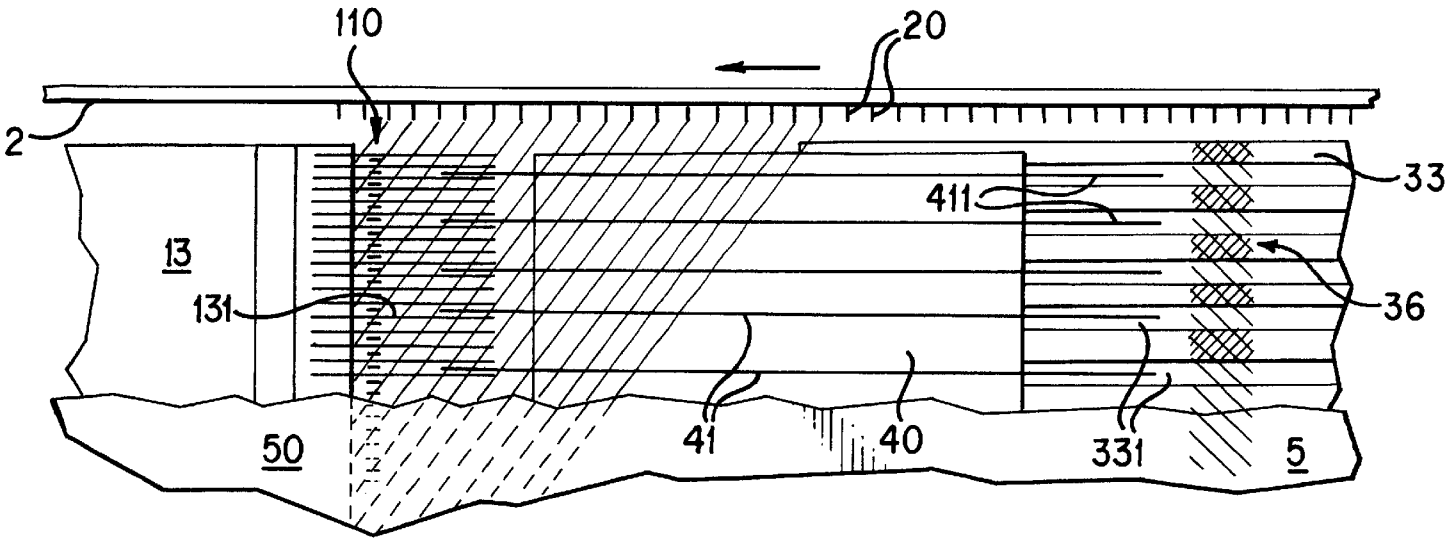
FIG. 4 shows an enlarged partial view (partially sectional) of the guiding elements from above.
Figure 5:
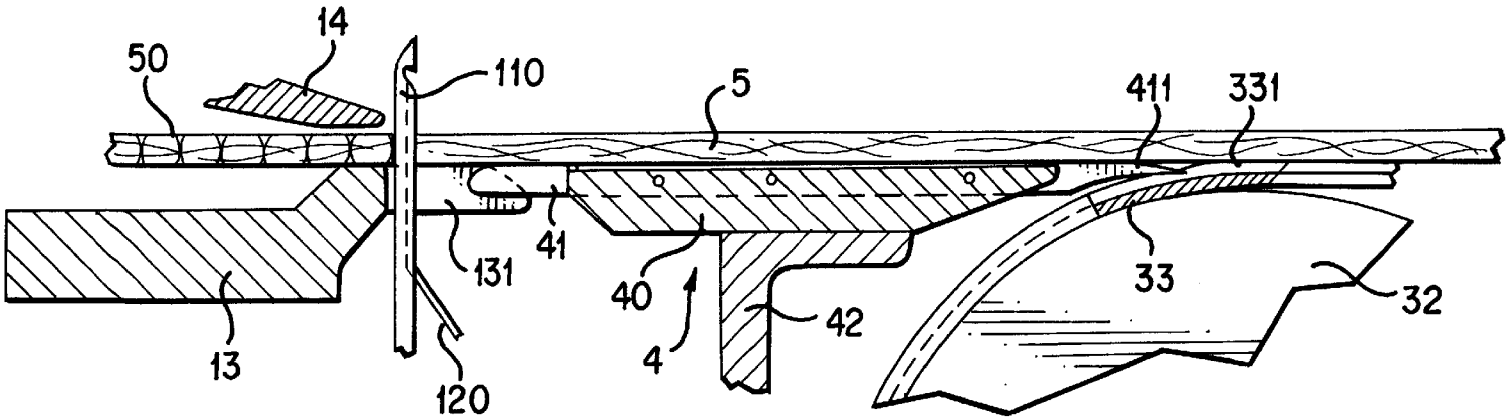
FIG. 5 shows a cross-sectional representation of FIG. 4.

The guiding elements 4 have at least one plate 40. As illustrated in FIGS. 4 and 5, a preferred embodiment of the invention includes guide jacks 41 which are inserted into the plate 40. FIGS. 1*a,* 4, 5 and 9 illustrate tips 411 of the guide jacks 41, directed toward the conveyor belt 33, which can engage grooves 331 in the surface of the conveyor belt 33 and in this way take over the yarn stratum without any backing up.

On the side facing the cast-off cam 13, as shown in FIGS. 4 and 5, other ends of the guide jacks 41 can intervene between the knock-over bits 131. The plate 40 can be constructed in several parts and can be braced detachably at rails fastened to the frame with the help of holders 42.

Endless conveyor belts 2 are disposed on either side of the knitting site 1. As shown in FIGS. 2 and 3, these belts are provided with hooks 20 for fixing the yarn layers and also for fixing the yarn stratum 5. One of the guide rollers 21 for the conveyor chains 2 is distanced from the knitting site 1. A second guide roller 22 is disposed regularly in the working direction behind knitting site 1.

An upper strand of the conveyor chains 2 moves continuously to the knitting site 1. Several multiple yarn guides 81, 82, which can be moved changeably in different directions over both conveyor chains 2, each place one yarn layer per traverse alternately in the hooks 20 of the two conveyor chains 2. In this way, several yarn layers of yarn sheets are placed one above the other regularly in different directions and finally transported as yarn layer 5 in the direction of the knitting site 1.

In order to avoid sagging of the yarn layer 5 between the conveyor chains 2, a conveyor belt 33, extending up to in front of the knitting site, is disposed between the conveyor chains 2 below the region of the multiple yarn guides 81, 82, 83. The upper strand of the conveyor belt 53 moves approximately parallel to the upper strand of the conveyor chains 2. In order to prevent sagging, it is supported from below, preferably by a guide plate 34. Instead of the guide plate 34, other supporting elements, such as a plurality of supporting rollers or backing-up rollers, can also be used.

The endless conveyor belt 33 is driven by a guide roller 32, which is adjacent to the knitting site 1. Conventional tensioning elements (not shown) can be assigned to the lower strand.

In order to avoid a deflection of the lower yarn sheets 51 of the yarn stratum 5 produced by the friction at the guiding elements 40 and 41 and operating in the direction opposite to the working direction, additional driving elements are assigned to the guiding elements 4.

In the simplest case, the lowest yarn layer 51 of the yarn stratum 5 is aligned diagonally. The yarns of this yarn layer 51, which are stretched diagonally directly over the guiding elements 40, 41, are tied in firmly at one end by the knitting site 1 and moved by the off take forcefully and in a defined manner in the driving direction.

The other end of these yarns 51 is fixed to the hook 20 of the conveyor chains 2. In addition, these yarns are pressed against the upper strand of the conveyor belt 33 by the parts of the yarn stratum 5 lying above and so guided as far as the discharging point 36. Any shifting of this yarn sheet 51 by the rubbing guiding elements 40, 41 is largely precluded.

If so-called stationary yarns 52 are placed by a yarn feed 83 directly over this yarn layer 51 in the warp direction, a deflection of the yarns 51 counter to the working direction is additionally avoided.

The friction between these stationary yarns 52 and the yarns of the lowest yarn layer 51 is greater than the friction between the yarns of the yarn stratum 5 and the guiding elements 40, 41, which are mostly metallic and very smooth.

The diagonal yarn layer 5 and the lower yarn layers 51 52 taken together act as the simplest and most reliable driving means for the whole of the yarn stratum S.

A further variation, which ensures that the yarn stratum 5 is driven in the region of the guiding elements 4, is the use of endless guiding wires 6. FIG. 1*a* illustrates how the endless guiding wires 6 are guided in the grooves 331 of the conveyor belt 33 if the continuous conveyor belt 33 is used. They then overcome the distance to the knitting site 1 above the guiding elements 4. At the same time, they assume the tasks of the tips 411 and the ends of the guide jacks 41 and avoid an accumulation of the yarn stratum 5 in the region of the transitions.

Figure 1:
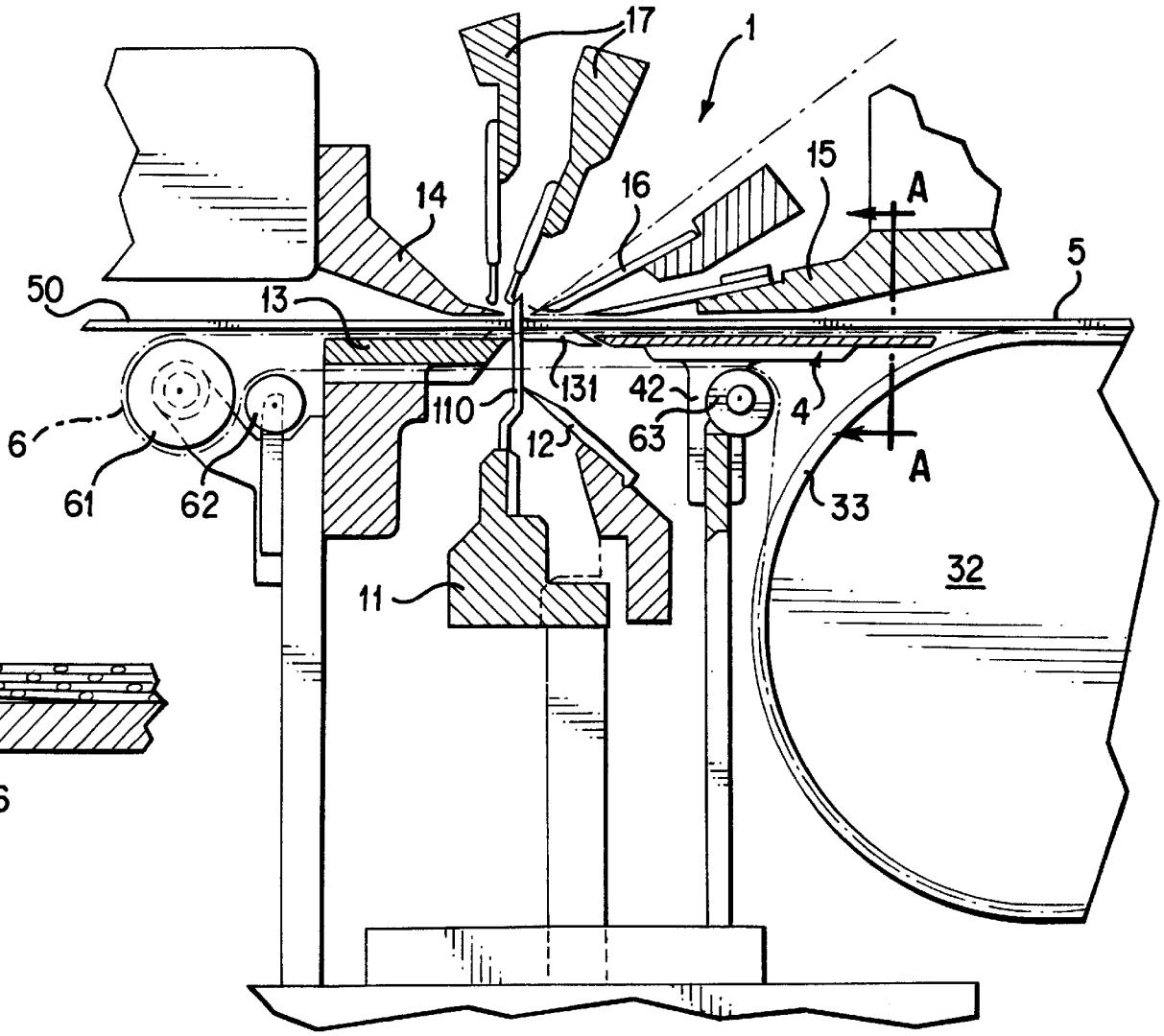
Figure 1A:
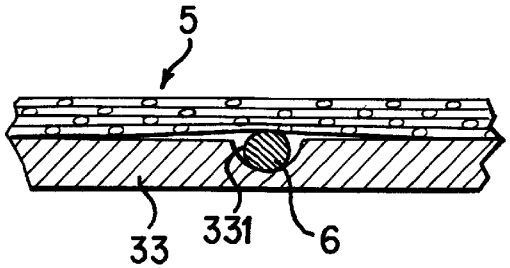

FIGS. 1–3 illustrate how the endless guiding wires 6 are guided below the knock-over edge as far as behind the row of needles 11, deflected by the idle rollers 61 and brought over guide rollers through the dent bars of the needles 11 once again into the region of the conveyor belt 33.

FIGS. 6, 6*a* and 7 illustrate a preferred embodiment of the invention wherein a large number of narrow conveyor belts 35 are used instead of the single broad conveyor belt 33, these endless wires 6' or narrow belts can also be guided only around the driving roller 32 of the conveyor belts 35. In this way, very long wires 6', the maintenance and installation of which would be extremely complicated, are avoided.

FIG. 8 illustrates a preferred embodiment in which endless wires are used, and many narrow conveyor belts 35 are used. The driving roller for these conveyor belts 35 is replaced by a plurality of guiding disks 320, which are mounted rigidly on the drive shaft 321.

Each conveyor belt 35 has its guiding disk 320. The endless wires 6" are guided above the drive shaft 321 through the dent bars of building disks 320. On the far side of these guiding disks 320, idle rollers 64 are provided, which deflect the endless wires 6" and guide them back between the conveyor belts 35 to the guiding elements 4. At least one of the idle rollers 61, 64 should function as a driving roller.

FIG. 9 illustrates an embodiment of the invention including a feed dog 7 mounted above the yarn stratum 5, which is guided on the guiding elements 4. This feed dog 7 has tips or teeth, which are directed downward. With its tips, it engages the yarn stratum 5 from above and transports it by about a loop length in the direction of the knitting site 1. It then lifts out of the yarn stratum 5, moves back and commences the process once again.

It is preferred to distribute such feed dogs 7, which correspond in their function to the feed dog of a sewing machine, at equal distances over the whole working width. It also preferred to dispose holding-down elements (similar to those labeled 15) above the yarn stratum 5 between these feed dogs 7. These holding-down elements disengage the yarn stratum 5 reliably from the tips of the feed dogs 7 and enable the feed dog 7 to be lifted back without interference.

FIG. 10 illustrates the conveyor belt 33', after it has crossed the stable guide roller 32, and is guided further over the guiding elements 43, deflected at the rollers 431 with the relatively small diameter close to the knocking-over bits 131 and guided back to the guide roller 32. Here also, the conveyor belt 33' can be provided with grooves 331, which are engaged by the tips of individual knockingover bits 131 at intervals.

This embodiment is advantageous, because the driven yarn stratum 5 can be guided up to the cast-off cam 13. The diagonal position of the lowest yarn layer 51, supported by the knocking over bit 131, ensures the trouble-free transport of the yarn stratum 5 over the short distance between the conveyor belt 33' and the knitting site 1.

The accessibility of the needle bar 11 and the slider bar 12 for the purpose of exchanging loop-forming elements (110, 120) can be assured owing to the fact that the guiding elements 43 are configured movably or pivotably. Preferably, the guiding elements 43 are also supported at the guiding roller 32.

In the example selected, supporting levers 432 with supporting rollers 433 are distributed over the working width and provided at the guiding element 43. These supporting levers 432 are pivotably mounted at the guiding element 43. In the operating position, the supporting rollers 433, contacting the guiding roller 32, hold the guiding rollers 431 in the working position close to the east-off cam 13. If access is to be provided to one of the bars 11 or 12, the coupling between the supporting lever 432 and the guiding element 433 is undone and the guiding element 43 can be swivelled or shifted out of the operating area.

In this case also, it is advisable to use the guide roller 32 as a driving roller for the conveyor belt 33'. To ensure the necessary arc of belt contact at the driving guide roller 32, a further supporting roller 322 is provided, which can also be driven with the same peripheral speed as the guide roller 32.

It will be understood that each of the elements described above, or two or more together, may also find a useful application in other types of applications differing from the type described above. Without further analysis, the foregoing will so fully reveal the gist of the present invention that others can, by applying current knowledge, readily adapt it for various applications without omitting features that, from the standpoint of prior art, fairly constitute essential characteristics of this invention.

What is claimed is:

1. An apparatus for supplying a multi-layer, multi-axial yarn stratum to a knitting site of a warp knitting machine, comprising:

a plurality of endless conveyor chains having an upper strand and a direction of movement toward said knitting site from opposite directions, said endless conveyor chains edged with hooks for guiding said yarn stratum;

at least two multiple yarn guides for each said yarn stratum, at least one of said multiple yarn guides having a central movement path inclined at an acute angle to the direction of motion of said conveyor chains;

means for supporting said yarn stratum placed between said conveyor chains wherein, between said conveyor chains, at least one endless conveyor belt is disposed, which is passed over guide rollers, mounted on a frame, and is driven synchronously with said conveyor chains and said upper strand of which is taken below the transporting plane of said yarn stratum and supported by supporting elements mounted on said frame, wherein a knock-over edge of a plurality of knock-over bits of said knitting site are approximately in the plane of said upper strand of said conveyor belt at a distance from immediately adjacent guide rollers; and the distance between said immediately adjacent guide roller and said knock-over bits of said knitting site below the transporting plane is bridged by supporting, guiding elements for said yarn stratum.

2. The apparatus of claim 1, wherein:

said conveyor belt extends as far as said knock-over bits and also embraces said guiding elements externally; and adjustable guiding means at said guiding elements above said slider bar are assigned to said conveyor belt.

3. The apparatus of claim 1, wherein driving elements for said yarn stratum provide driving force and are distributed over the working width of said knitting site assigned to said guiding elements.

4. The apparatus of claims 1 or 2, wherein an upper surface of said conveyor belt is provided with grooves extending in a circumferential direction, engaged by said guiding elements, said knocking-over bits proximal to the discharging position of said yarn stratum.

5. The apparatus of claim 3, wherein said conveyor belt consists of several, narrow, individual conveyor belts, which are guided parallel to one another and between which said guiding elements, said knocking-over bits and said driving elements engage.

6. The apparatus of claims 1, 2 or 3, wherein said driving elements are formed by a lower yarn sheet, yarns of which extend diagonally to said knitting site and are supported on said conveyor belt and said guiding elements.

7. The apparatus of claims 1, 2 or 3 wherein said driving elements are formed by an assemblage of endless revolving wires and wherein said assemblage of revolving wires is guided in grooves of said conveyor belt or in dent bars between said individual narrow conveyor belts and from there up to said knock-over edge of said knitting site below said yarn stratum and turned around behind said knitting site and guided back.

8. The apparatus of claim 5 wherein said assemblage of endless wires, after being turned around behind said knitting site, is guided back below said knock-over edge through said dent bars between said needle shanks.

9. The apparatus of claim 8, wherein:

said yarn stratum is guided on individual narrow conveyor belts, wherein a guiding disk is assigned to each narrow conveyor belt on said drive shaft near said knitting site; and said assemblage of endless wires, after being turned around behind said knitting site below said knock-over edge, is guided back through said dent bars between said needle shanks and said assemblage of endless wires above said drive shaft is guided through said dent bars of said driving disks, subsequently turned around over a separate idle roller and finally taken over said guiding elements once again to said yarn stratum.

10. The apparatus of claims 1 or 3, wherein:

said driving elements for said yarn stratum is disposed above said yarn stratum; and said driving elements are equipped with downwardly directed pointed projections, which take hold of and transport said yarn stratum.

11. An apparatus for supplying a multi-layer, multi-axial yarn stratum to a knitting site of a warp knitting machine, having two conveyors positioned on either side of the knitting site for conveying at least one sheet of yarn in a direction toward the knitting site, comprising:

endless conveyor chains interconnected with said conveyors, having at least one conveyor belt, said conveyor chains and said at least one conveyor belt moving synchronously, said chains having an upper and a lower strand and including hooks for guiding the yarn stratum, said conveyor chains running with said upper strand in a position to said knitting site;

at least two multiple yarn guides for each yarn sheet, at least one of said multiple yarn guides having a central movement path inclined in a generally acutely angular direction to the direction of the motion of said conveyor chains; and means for supporting said yarn stratum positioned between said conveyor chains, said means including at least one endless conveyor belt disposed between said conveyor chains for being carried over guide rollers mounted on a frame, the at least one endless conveyor belt having an upper and a lower strand, the upper strand positioned adjacent to and below the transporting plane of the yarn layer and supported by supporting elements, mounted on the frame, wherein a knock-over edge of knock-over bits of said knitting site are positioned in common planar alignment with said upper strand of said conveyor belt, said conveyor belt placed in spaced apart juxtaposition relative to immediately adjacent guide rollers, wherein the space between said immediately adjacent guide roller and said knock-over bits of said knitting site below said transporting plane is bridged by supporting, guiding elements for said yarn stratum.

12. The apparatus of claim 11, further comprising said conveyor belt extending as far as said knock-over bits and superimposed over the guiding elements wherein said guiding rollers at said guiding elements are positioned above a region of movement of a slider bar and are assigned to said conveyor belt.

13. The apparatus of claim 12, wherein driving elements for said yarn stratum providing conveying direction are distributed over the working width of said knitting site and are assigned to said guiding elements.

14. The apparatus of claim 13, wherein said upper strand of said conveyor belt is provided with grooves extending in a circumferential direction and engaged with said guiding elements, said driving elements providing the conveying direction for said knocking-over bits at proximal distance to the discharging position of said yarn stratum.

15. The apparatus of claim 14, wherein said conveyor belt consists of several narrow, individual conveyor belts guided in parallel motion to one another and positioned to engage said guiding elements, said knocking-over bits and said driving elements.

16. The apparatus of claim 15, wherein said driving elements are formed by a lower yarn sheet, yarns of said lower yarn sheet extending diagonally to said knitting site and supported by said conveyor belt and said guiding elements.

17. The apparatus of claim 15, wherein said driving elements are formed by an assemblage of endless revolving wires wherein said assemblage of revolving wires is guided in said grooves of said conveyor belt or in dent bars, positioned between said individual narrow conveyor belts, and further guided to said knock-over edge of said knitting site disposed below said yarn stratum to turn around and proceed in a reverse motion behind said knitting site.

18. The apparatus of claim 17, wherein said assemblage of endless wires, after being turned around behind said knitting site, is guided back below said knock-over edge through said dent bars between said needle shanks.

19. The apparatus of claim 18, wherein said yarn stratum is guided by individual narrow conveyor belts wherein a guiding disk is assigned to each narrow conveyor belt on said drive shaft near said knitting site wherein said assemblage of endless wires, after being turned around behind said knitting site below said knock-over edge, is guided back through said dent bars between said needle shanks and wherein said assemblage of endless wires above said drive shaft is guided through said dent bars of said driving disks, subsequently turned around over a separate idle roller and finally taken over said guiding elements once again to said yarn stratum.

20. The apparatus of claim 19, wherein said driving elements for said yarn stratum are disposed above said yarn stratum and wherein said driving elements are equipped with downwardly directed pointed projections, said downwardly pointed projections holding and transporting said yarn stratum.

* * * * *